United States Patent [19]

Richter

[11] Patent Number: 4,870,798

[45] Date of Patent: Oct. 3, 1989

[54] DOUBLE LOCK STANDING SEAM ROOF SHEET

[75] Inventor: Allen R. Richter, Romeo, Mich.

[73] Assignee: Walcon Corp., Southfield, Mich.

[21] Appl. No.: 306,059

[22] Filed: Feb. 6, 1989

[51] Int. Cl.[4] ..... E04B 1/00

[52] U.S. Cl. ..... 52/528; 52/529; 52/537; 52/545

[58] Field of Search ..... 52/537, 588, 536, 538, 52/545, 547, 478, 529, 528

[56] References Cited

U.S. PATENT DOCUMENTS

| | | | |
|---|---|---|---|
| 1,913,342 | 6/1933 | Schaffert | 52/537 X |
| 4,231,206 | 11/1980 | Hafner | 52/529 |
| ° 4,546,590 | 10/1985 | Finchet et al. | 52/588 X |
| 4,741,142 | 5/1988 | Otto et al. | 52/545 X |

*Primary Examiner*—Henry E. Raduazo
*Assistant Examiner*—Creighton Smith
*Attorney, Agent, or Firm*—Robert G. Mentag

[57] ABSTRACT

A metal roof panel having its longitudinal edges roll-formed to define a double locking standing seam structure along both edges. An integral upstanding flange is formed on one longitudinal edge with a lower male locking means and an upper female locking means. An integral upstanding flange is formed on the other longitudinal edge with a lower female locking means and an upper male locking means. A plurality of roof clips are adapted to have one side nested in the lower female locking means of one panel and held therein by the lower male locking means on an adjacently disposed panel.

2 Claims, 2 Drawing Sheets

DOUBLE LOCK STANDING SEAM ROOF SHEET

BACKGROUND OF THE INVENTION

1. Technical Field

The field of art to which this invention pertains may be generally located in the class of devices relating to building roofs. Class 52, Roofs and Roofing, United States Patent Office Classification, appears to be the applicable general area of art to which the subject matter similar to this invention has been classified in the past.

2. Background Information

It has been known to provide metal standing seam roof panels which have edge portions folded over and adapted to interlock with each other to form roof coverings. However, a problem encountered with the prior art metal interlocking standing seam roof panels is that when they are subjected to a negative loading, the wind uniformly tends to lift the flat sheet portions of such panels upwardly, and to unhook the joints where the roof panels are joined together, and as a result the disconnected panels are lifted off of the building on which they were mounted.

SUMMARY OF THE INVENTION

In accordance with the present invention, a roll formed metal double lock standing seam roof panel is provided which is designed for the commercial and industrial roof market. The design differs from existing prior art roof interlocking panels in that it provides greater resistance to negative loading with a double lock standing seam which includes an interlock at the base of the standing seam.

The bottom interlock is held open by the panel sheet as it is roll formed, to provide for ease of installation. The bottom interlock also provides a lip for a clip attachment for attaching the roof panel to a building, thus allowing the clip to be loaded in the more direct manner than the prior art systems now available on the market.

The design features of the present invention allow a roof panel to meet architectural standards when manufactured in lighter gages with wider rib centers then heretofore possible, thus giving the manufactured roof panel a competitive advantage over existing roof panels.

DESCRIPTION OF THE PREFERRED EMBODIMENT

Figure 1:
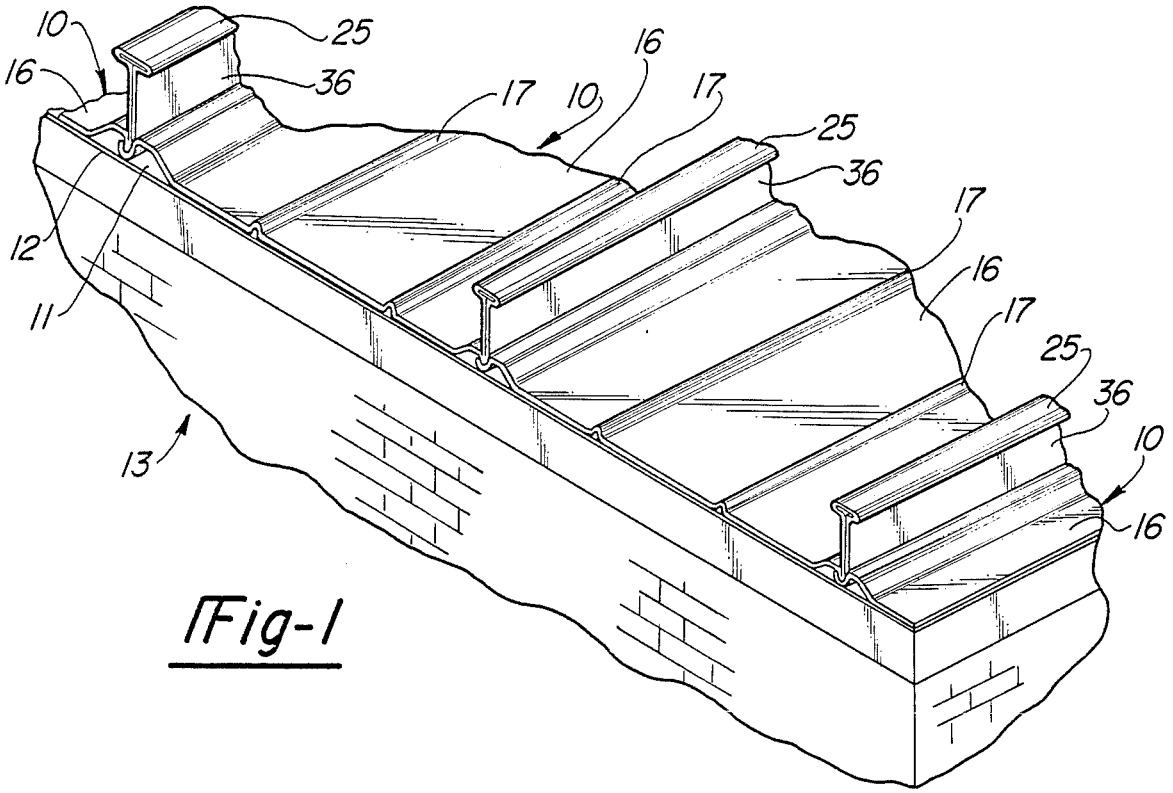
FIG. 1 is a fragmentary, perspective view of a double lock standing seam roof made in accordance with the present invention, and showing the same mounted on a building roof.
Figure 3:
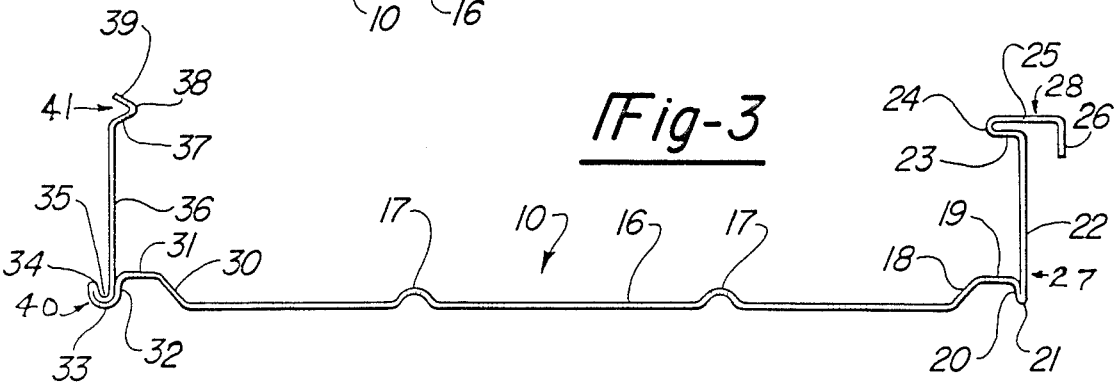
FIG. 3 is an end view of a double lock standing seam roof panel made in accordance with the principles of the present invention.

Referring now to the drawings, the numeral 10 generally designates a series of roofing panels mounted on the upper surface 11 of a roof 12 on an illustrative building, generally indicated by the numeral 13. The panels 10 are formed from a suitable sheet metal as for example, flat roll stock steel or aluminum. As shown in FIGS. 1 and 3, each of the panels 10 includes a sheet 16 which is provided with a plurality of laterally spaced apart corrugations 17 that extend along the length of each panel 10. As illustrated in FIG. 3, each of the panels 10 has an integral upstanding flange 22 formed along one longitudinal edge thereof and an upstanding flange 36 integrally formed along the other longitudinal edge thereof. A lower male locking means, generally indicated by the numeral 27, is integrally formed on the lower end of the upstanding flange 22 and an upper female locking means, generally indicated by the numeral 28, is integrally formed on the upper end of the upstanding flange 22. A lower female locking means, generally indicated by the numeral 40, is integrally formed on the lower end of the upstanding flange 36 and an upper male locking means 41 is integrally formed on the upper end of the upstanding flange 36. The upstanding flanges 22 and 36 are disposed at right angles to the horizontal plane of the panel sheet 16.

As shown in FIG. 3, the lower male locking means 27 is formed by a rolled configuration of the right edge of the panel sheet 16. The right edge of the panel sheet 16 is formed with an integral upwardly and outwardly sloping portion 18, which in one embodiment sloped upwardly at about a 45 degree angle from the horizontal plane of the sheet 16. The upper end of the angled sheet edge portion 18 is integral with a horizontal outwardly extended portion 19 which terminates at the top end of a vertically disposed and downwardly extended sheet edge rib 20. The lower end of the rib 20 is integral with the lower end 21 of the upstanding flange 22. The rib 20 forms a downwardly extending male locking member with the lower end 21 of the upstanding flange 22.

As shown in FIG. 3, the upper female locking means 28 includes an integral inwardly extended, horizontal leg portion 23 which is integral at its inner end with a U-shaped rib portion 24. The upper end of the U-shaped rib portion 24 is integral with a horizontal, outwardly extended leg portion 25 that extends outwardly beyond the upstanding flange 22, and which is disposed perpendicular to the flange 22. Integrally formed on the outer end of the horizontal leg portion 25 is a downwardly extended integral locking rib 26.

As shown in FIG. 3, the lower female locking means 40 is integrally formed by the rolled left edge of the panel sheet 16. The left edge of the panel sheet 16 has a first upwardly and outwardly sloping portion 30, which in one embodiment was disposed at an angle of 45 degrees from the horizontal plane of the panel sheet 16. Integral with the upper end of the sheet edge portion 30 is a horizontal portion 31 which extends outwardly and is integrally connected at its outer end to a downwardly extended rib portion 32. The lower end of the longitudinal rib portion 32 is integral with a U-shaped longitudinal rib 33. The upper end of the outer leg of the U-shaped rib 33 is integral at its upper end with a second U-shaped rib 35, which is seated in and nested in the first U-shaped rib 33 to form a female locking socket.

As shown in FIG. 3, the upper male locking means 41 includes an integral V-shaped member. Said V-shaped male locking member includes an inwardly and upwardly angled integral lower leg 37. The upper end of the leg 37 is integral at the point 38 with the lower end of an upper, outwardly and upwardly angled leg 39. In one embodiment the male locking member legs 37 and 38 were each disposed at an angle of 30 degrees from a horizontal axis through the junction point 38 between these legs.

Figure 4:
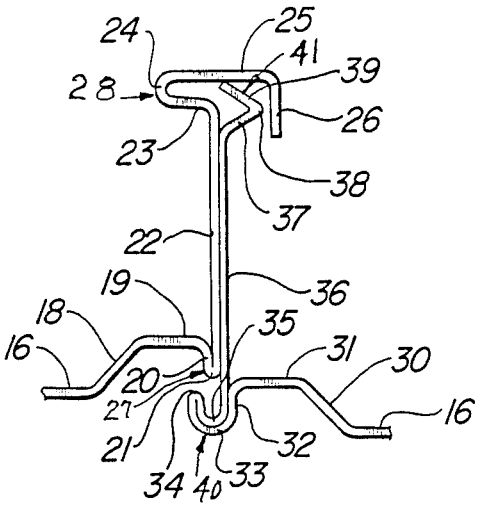
FIG. 4 is an elevation end view of the interconnecting ends of a roof panel made in accordance with the principles of the present invention, and showing the same before the double lock seam is rolled.
Figure 5:
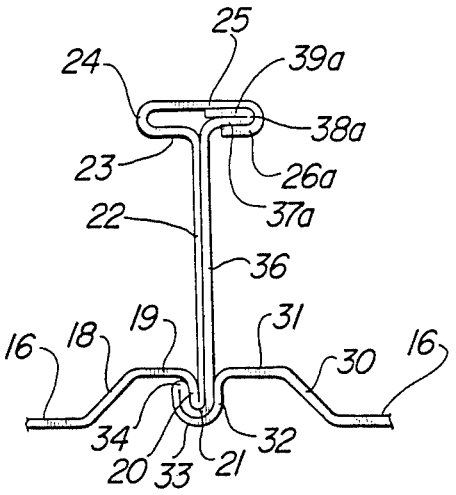
FIG. 5 is an elevation end view, similar to FIG. 4, but showing the double lock standing seam after it is mechanically seamed in the field.

In use, a metal roof panel structure is formed with a plurality of panels 10 by disposing the male and female locking means of an adjacent panel in the position shown in FIG. 4. The upper female locking means 28 is disposed to receive the upper male locking means 41 of an adjacent panel 10 while the lower male locking means 27 carrying the upper female locking means 28 is disposed in position spaced above the lower female locking means 40. As shown in FIG. 5, the next step in the assembly of one panel 10 to an adjacent panel 10 is to clinch the upper female locking means 28 to the upper male locking means 41 with a suitable, conventional, mechanical seamer, which seaming action moves the lower male locking means 27 downwardly into the lower female locking means 40 and clinches the upper male locking means 41 in the upper female locking means 28.

Figure 2:
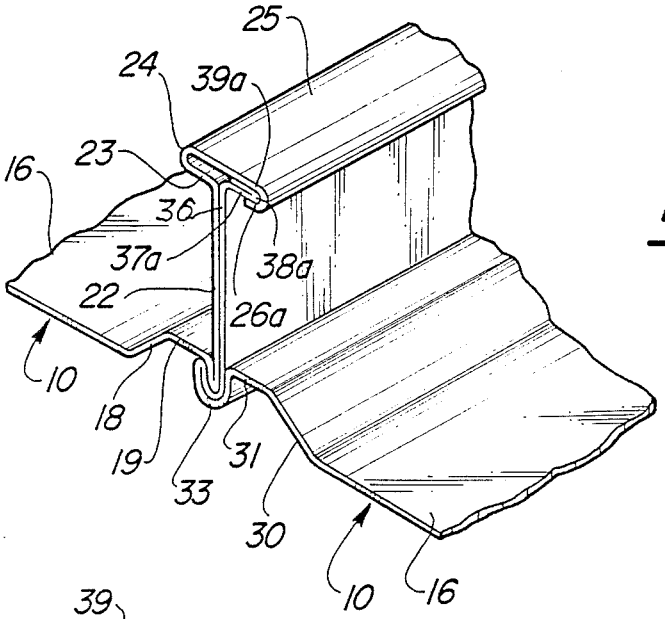
FIG. 2 is a fragmentary, perspective view of a double lock standing seam roof structure of the present invention after it is formed in the field.

It will be seen that the structure shown in FIGS. 1, 2 and 5 provide a finished product which is locked together at the top and bottom thereof, to provide a double lock standing seam roof panel structure which is water tight and which provides additional loading capacity over the capacity of the prior art roofing structures. The upper locking structure which includes the upper female locking means 28 and the upper male locking 41 provides an upper water tight lock at the top of the standing seam. The bottom interlocking structure comprising the lower male locking means 27 and the lower female locking means 40 provides a bottom interlock structure which provides resistance to negative loading when a strong wind uniformly tries to lift the roofing structure off of a building. The double locking standing seam structure of the present invention restricts both vertical and lateral movement between the various joint members.

The double locking standing seam structure of the present invention provides a roofing panel strong enough to permit the corrugations 17 to be laterally spaced apart a further distance than was heretofore possible when employing sheet metal of a light gage.

Figure 7:
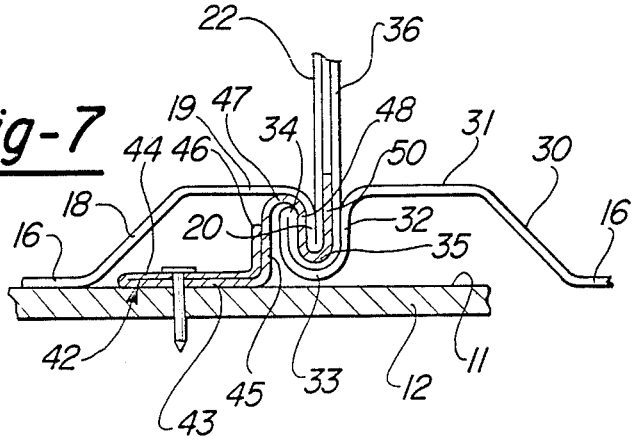
FIG. 7 is a fragmentary end view of the bottom interlock structure of the invention and showing the provision of a roof clip for retaining the roof panels on a building.
Figure 6:
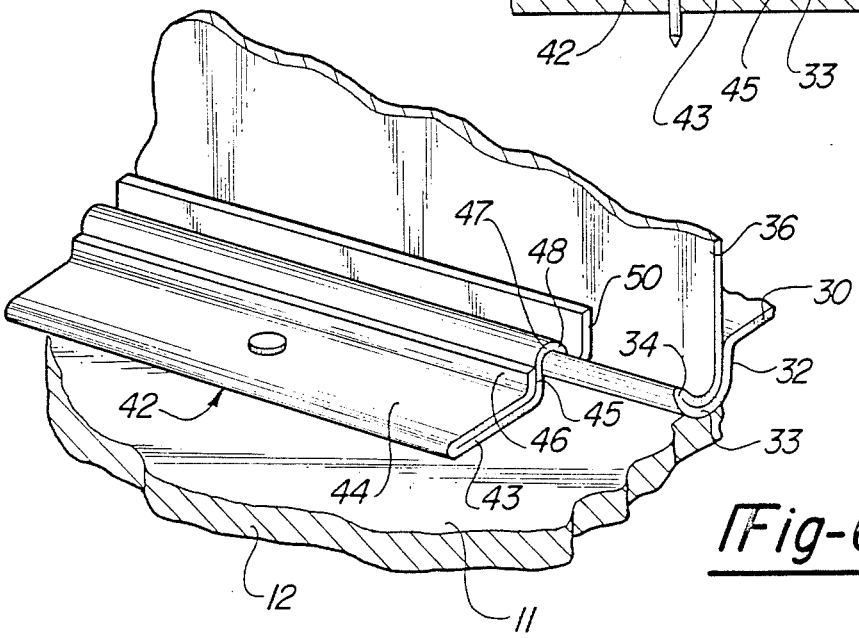
FIG. 6 is a fragmentary, elevation perspective view of the double lock standing seam structure employed in the invention, and with one of the mating roofing panels removed.

As shown in FIGS. 6 and 7, a fixed roof clip, generally indicated by the numeral 42, is employed for fixedly securing the panels 10 to a building roof deck. A plurality of the clips 42 would be employed at spaced apart positions along the length of the panels 10. As best seen in FIG. 6 the roof clip 42 includes a longitudinally extended flat portion which would be seated on the upper surface 11 of a building roof and secured thereto by any suitable fastening means, as for example, fastener screws 51. The flat portion of the roof clip 42 is formed by two horizontal leg portions 43 and 44 which are folded over to form a flat clip portion. The inner edge of the flat portion 44 is integral with an upstanding longitudinal flange portion 46. The inner end of the flat portion 43 is also integral with an upwardly extended flat flange portion 45. The flange portions 45 and 46 are disposed perpendicular to the flat horizontal portions 43 and 44. The upper end of the flange portion 45 is integral with an S-shaped longitudinal portion which is adapted to be seated in the lower female locking means 40 and to be held securely in place in said lower female locking means by the lower male locking means 27. Said S-shaped clip portion includes the integral arcuate portions 47 and 49, and the integral flanges 48 and 50. The clips 42 are applied at suitable lengths along the panels 10 as for example, every 5, 6 or 8 feet. The roof clips 42 would be disposed in position in the lower female locking means 40, at these desired positions, before the mating male and female locking means are mechanically seamed together. The roof clips 42 would be disposed in their respective positions with their S-shaped portions disposed in the lower female locking means 40 and fastened to a building roof structure before an adjacent panel 10 is moved into the position shown in FIG. 4, preparatory to clinching two adjacent panels together, as shown in FIGS. 5 and 7.

What is claimed is:

1. A metal roof panel, of the type adapted to form a roof panel structure having a standing seam joint between an adjoining pair of said panels which are adapted to seat on the surface of a roof, characterized in that:

(a) said panel comprises a planar sheet portion having an upstanding integral flange along each longitudinal edge thereof, which extend generally perpendicular to the plane of the panel;

(b) the flange along one longitudinal edge of the panel has integrally formed, on the lower end thereof, a lower male locking means, and on the upper end thereof an upper female locking means;

(c) the flange along the other longitudinal edge of the panel has integrally formed, on the lower end thereof, a lower female locking means, and on the upper end thereof an end thereof an upper male locking means; and, (d) whereby, the upper male locking means on one of an adjoining pair of said panels is interengaged with the upper female locking means on the other of an adjoining pair of said panels by relative upward forward movement along a line generally perpendicular to the planar sheet portions of said pair of panels, and the lower male locking means on the other of said pair of panels is adapted to engage and slide downward along the upstanding flange carrying the lower female locking means on said one of said pair of panels and into an interlocking engagement with said lower female locking means upon the application of a mechanical seaming force on the interengaged upper male and upper female locking means to clinch the upper male and upper female locking means together in a water tight condition for forming a double lock standing seam between an adjoining pair of said panels.

2. A metal roof panel structure as defined in claim 1, characterized in that:

(a) roof clips are provided which each have a roof engaging portion for fastening to a building roof structure, and a panel interengaging portion for locking interengagement between a lower female locking means on one of said panels and a lower male locking means on an adjoining one of said panels.

* * * * *